US006554222B1

(12) United States Patent
Lindow, Sr.

(10) Patent No.: US 6,554,222 B1
(45) Date of Patent: Apr. 29, 2003

(54) PAPER HOLDER AND DISPENSING APPARATUS

(76) Inventor: Kenneth T. Lindow, Sr., 400 Quick Draw, Horseshoe Bay, TX (US) 78657

( * ) Notice: Subject to any disclaimer, the term of this patent is extended or adjusted under 35 U.S.C. 154(b) by 0 days.

(21) Appl. No.: 10/079,393

(22) Filed: Feb. 20, 2002

(51) Int. Cl.[7] ..... B65H 16/06

(52) U.S. Cl. ..... 242/598.5; 242/599.3; D6/522; D6/523

(58) Field of Search ..... 242/598.3, 598.5, 242/596.8, 599.3, 422.5; 312/34.8; D6/522, 523

(56) References Cited

U.S. PATENT DOCUMENTS 438,567 A * 10/1890 Wheeler ..... 242/598.5
1,373,797 A * 4/1921 Carr ..... 242/598.5
1,664,392 A * 4/1928 Baruch ..... 242/598.5
1,973,354 A * 9/1934 Nedberg ..... 242/598.5
2,650,773 A * 9/1953 Fanning ..... 242/598.5

FOREIGN PATENT DOCUMENTS

WO WO 97/19013 * 5/1997

* cited by examiner

*Primary Examiner*—John Q. Nguyen
(74) *Attorney, Agent, or Firm*—Bill B. Berryhill

(57) ABSTRACT

A dispenser for holding and dispensing sheets of paper from paper rolled on a tubular core, including a base member by which the dispenser may be attached to a wall and first and second rigid support arms at each end of the base member providing a pair of inclined openings extending upwardly from the base when the base is mounted on a vertical wall. A spindle member is insertable through the tubular core on which the paper is rolled. Opposite ends of the spindle are receivable in a corresponding one of the inclined openings allowing the spindle and rolled paper to move by gravity against the base member but permitting sheets of paper to be dispensed therefrom.

7 Claims, 2 Drawing Sheets

PAPER HOLDER AND DISPENSING APPARATUS

BACKGROUND OF THE INVENTION

1. Field of the Invention

The present invention pertains to apparatus for holding and dispensing paper. More specifically, the present invention pertains to a dispenser for holding and dispensing sheets of paper from paper rolled on a tubular core.

2. Description of the Prior Art

Paper towels are widely used today in homes as well as in businesses. Such towels are typically rolled on a tubular core and perforated so that single sheets may be torn from the roll as needed. There are many types of towel dispensers, particularly for use in kitchens and bathrooms. In the simplest designs, the paper towel is supported from a base member attached to the wall from which a pair of support arms project with inwardly directed cylindrical hubs thereon. The arms are spread slightly apart so that the hubs may engage the ends of the tubular core. Paper may then be pulled from the paper roll. However, this usually requires two hands, one to hold the paper roll and the other to tear a sheet therefrom. If one of the hands is occupied or covered with food, as frequently occurs in the kitchen, pulling on the roll of paper with one hand may result in dispensing of too many sheets of paper and waste.

There are a number of other holder designs, examples of such may be seen in U.S. Pat. Nos. 1,973,354; 4,483,491; 5,899,407 and 6,267,322. While each of these designs is an improvement over the simple support described above, most of them still require two-handed operation. If not, they have relatively complicated mechanisms for doing so.

There are similar dispensers for toilet paper. U.S. Pat. No. 3,356,429 is an example of a dispenser especially designed for toilet paper. Similar operational problems are associated therewith.

SUMMARY OF THE PRESENT INVENTION

The present invention is a dispenser for holding and disposing sheets of paper from paper rolled on a tubular core. Although it is primarily designed for dispensing sheets of paper from paper towels, it can also be used for toilet tissue or the dispensing of sheets of paper of any kind of paper which is rolled onto a tubular core. The dispenser of the present invention provides a base member by which it may be attached to a wall, first and second rigid support arms at each end of the base member and a spindle member insertable through the tubular core on which paper is rolled, the spindle member being supported at opposite ends by the support arms. Each of the support arms provides an inclined opening extending upwardly from the base, when the base is mounted on a vertical wall, and the opposite ends of the spindle member are receivable in corresponding inclined openings of each of the support arms. This allows the spindle and rolled paper thereon to move, by gravity, against the base member, frictionally preventing accidental or excessive dispersing but permitting selected sheets of paper to be dispensed therefrom.

In a preferred embodiment of the invention, the support arms are formed by unshaped wire members each of which defines, between opposing upward and lower legs thereof, the inclined opening provided by the support arms. The spindle member is cylindrical and provided, at each end thereof, with a circular groove which is engageable with a corresponding lower leg of one of the unshaped support arms to guide the spindle and the rolled paper within the inclined opening. The rolled paper moves, by gravity, against the base member and enough friction is provided against the roll of paper to prevent excessive unrolling but to allow tearing of sheets therefrom, even with one hand.

While the dispenser of the present invention is primarily designed for dispensing of paper towels, it can also be used for toilet tissue or dispensing sheets of paper from any kind of paper rolled on a tubular core. Many other objects and advantages of the invention will be understood from reading the specification which follows in conjunction with the accompanying drawings.

DESCRIPTION OF A PREFERRED EMBODIMENT OF THE INVENTION

Figure 1:
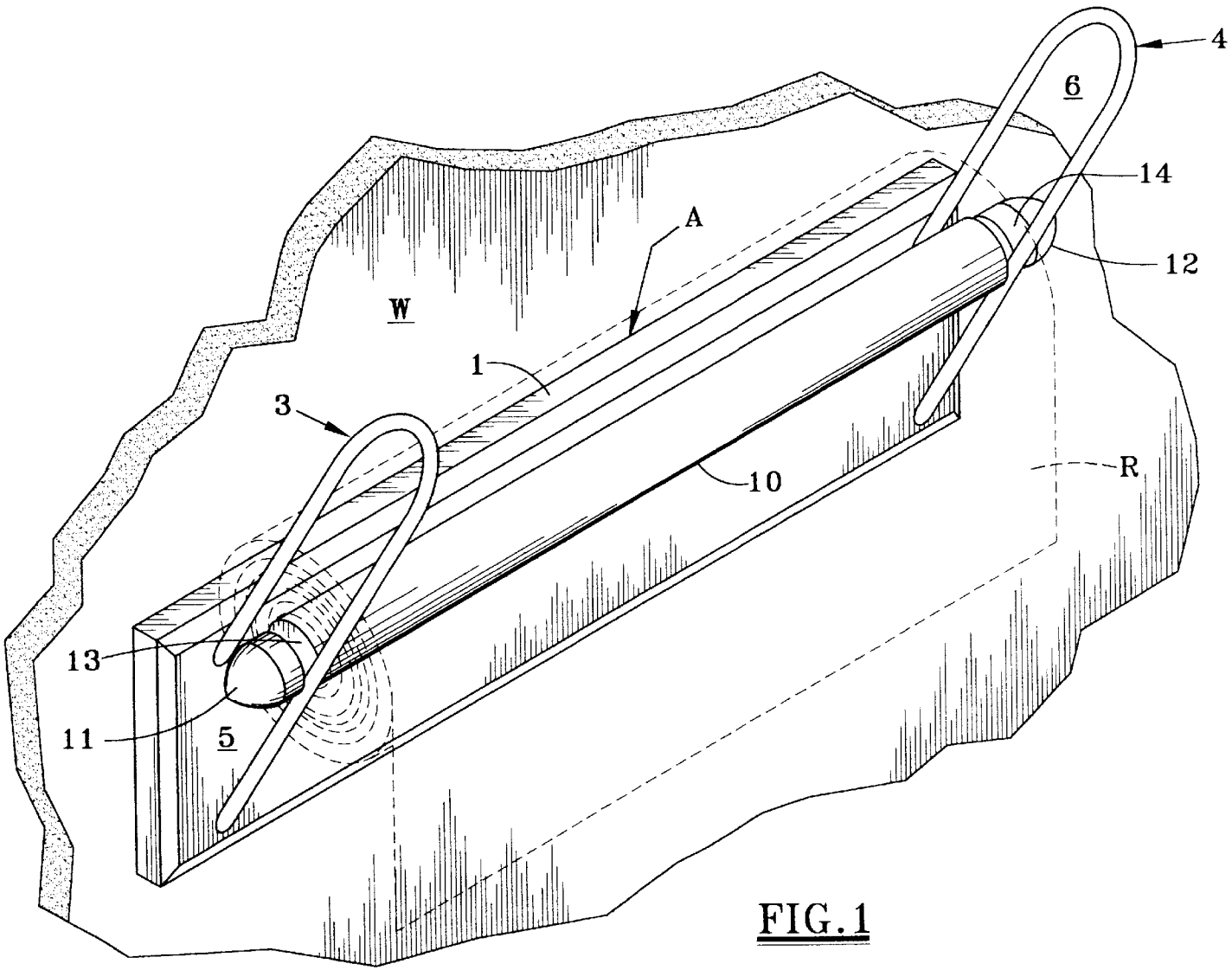
FIG. 1 is a pictorial representation of the dispensing apparatus of the present invention attached to a wall and supporting a roll of paper towels thereon, according to a preferred embodiment of the invention.
Figure 2:
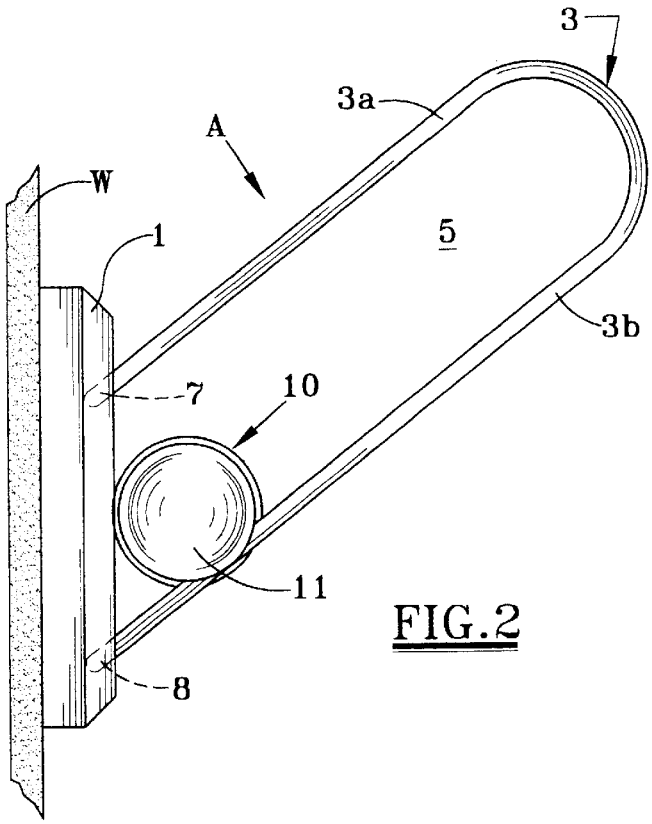
FIG. 2 is an end view of the dispensing apparatus of the present invention shown attached to a wall which is in cross section.
Figure 3:
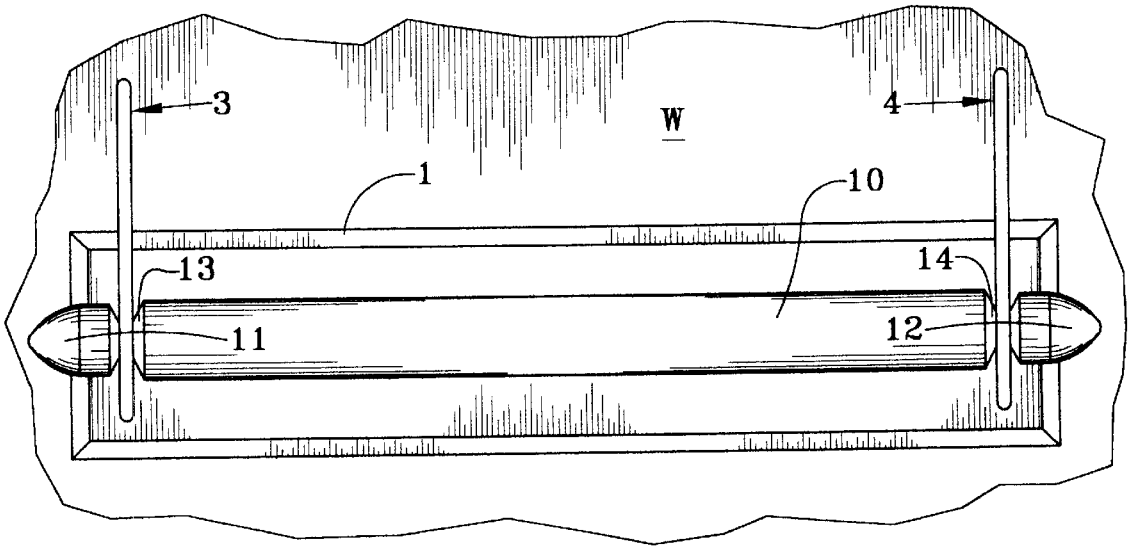
FIG. 3 is a front view of the dispensing apparatus of the present invention.

Referring first to FIG. 1 there is shown paper dispensing apparatus A attached to a wall W and holding a roll of paper towels R thereon. Referring also to FIGS. 2 and 3, the dispenser A has an elongated base member 1 which may be attached to the wall W by screws (not shown) or any other suitable fasteners. Supported at opposite ends of the base member 1 are first and second rigid support arms 3 and 4. In the exemplary embodiment the support arms 3 and 4 are formed by unshaped wire members having opposing parallel upper and lower legs 3*a*, 3*b* and 4*a*, 4*b*, respectively. They thus define or provide openings 5 and 6 which are inclined, extending upwardly from the base 1 when the base is mounted on the wall W. The base member 1 is provided with spaced apart pair of inclined holes such as illustrated at 7 and 8 in FIG. 2. Each of a pair of inclined holes comprises an upper hole 7 and a lower hole 8 for receiving corresponding ends of upper and lower legs 3*a*, 3*b* and 4*a*, 4*b*, respectively.

The paper roll R is supported on a spindle member 10 which is insertable through the tubular core on which the paper is rolled. In the exemplary embodiment, the spindle is an elongated cylindrical member 10 which is tapered at each end 11 and 12 and provided near the ends 11 and 12 with circular grooves 13 and 14. The circular grooves 13 and 14 are spaced apart by the same distance as the space between support arms 3 and 4 and are sized to engage a corresponding lower leg 3*b*, 4*b* of the unshaped support arms 3 and 4 to guide the spindle 10 and the paper roll R to be placed thereon within the inclined openings 5 and 6.

Thus, the spindle 10 may be inserted through a roll of paper R and the ends of the spindle received in the corresponding inclined openings 5, 6 of each of the support arms 3 and 4, the grooves of the spindle actually engaging and resting on the lower legs 3*b* and 4*b* of the support arms 3, 4. When released, the spindle and the roll of paper R move, by gravity, against the base member 1. This happens regardless of the diameter of the roll of paper R. The angle of incline of openings 5, 6, and the weight of the roll of paper R and the spindle 10, the friction created against the base 1, due to gravitational pull, and inertia allows paper to be unrolled and allows one sheet to be separated along perforations even with one hand. No complicated mechanisms are required.

The base member 1 and the spindle 10 can be made of any number of materials including wood, plastic and metal. The support arms 3 and 4 in the exemplary embodiment are wire. However, the support arms may take different forms as long as they provide inclined openings which extend upwardly from the base 1. In such cases, the support arms 3 and 4 may be made of other materials, including wood, plastic or metals. In fact, many variations of the invention can be made without departing from the spirit of the invention. Accordingly, it is intended that the scope of the invention be limited only by the claims which follow.

What is claimed is:

1. A dispenser for holding and dispensing sheets of paper from paper rolled on a tubular core, said dispenser comprising:

a base member by which said dispenser may be attached to a wall;

first and second rigid support arms, one at each end of said base member, each of said support arms comprising a pair of parallel wire members, an upper one above a lower one, extending upwardly from said base member and providing therebetween an inclined opening extending upwardly from said base when said base is mounted on a vertical wall; and a spindle member insertable through said tubular core on which said paper is rolled and opposite ends of which are receivable in corresponding inclined openings of said support arms, each of said opposite ends being respectively provided with a groove which is engageable with a corresponding one of said lower wire members to guide said spindle member and said rolled paper thereon within said inclined openings and allowing said spindle member and said rolled paper to move by gravity against said base member but permitting sheets of paper to be dispensed therefrom.

2. The paper dispenser of claim 1 in which said inclined openings and the materials of said dispenser are selected to allow unrolling of said paper but providing enough friction against said roll of paper to allow tearing of sheets therefrom.

3. The paper dispenser of claim 1 in which each of said pair of parallel wire members are so formed from a single length of wire bent at the uppermost portion of said inclined opening to form distal ends of said support arms.

4. The paper dispenser of claim 1 in which said base member is provided at each end thereof with a pair of holes, one above the other, for receiving corresponding ends of each of said parallel wire members and providing support for said arms formed thereby.

5. A dispenser for holding and dispensing sheets of paper from paper rolled on a tubular core, said dispenser comprising:

a base member by which said dispenser may be attached to a wall;

first and second rigid support arms formed by u-shaped wire members each of which provide between opposing upper and lower legs thereof an inclined opening extending upwardly from said base when said base is mounted on a vertical wall; and a cylindrical spindle member insertable through said tubular core on which said paper is rolled and opposite ends of which are receivable in corresponding inclined openings of each of said support arms, each of said opposite ends of said spindle member being respectively provided with a circumferential groove which is engageable with a corresponding lower leg of one of said u-shaped support arms to guide said spindle member and said rolled paper thereon within said inclined opening and allowing said spindle member and said rolled paper to move by gravity against said base member but permitting sheets of paper to be dispensed therefrom.

6. The paper dispenser of claim 5 in which said base member is provided with spaced apart pairs of holes, each of said pair of holes comprising an upper hole and a lower hole, said upper hole and said lower hole for receiving corresponding ends of upper and lower legs, respectively, of each of said u-shaped wire members forming said first and second support arms.

7. The paper dispenser of claim 5 in which the weight of said spindle member and the angle of said inclined openings, are selected to aid gravity, friction and inertia in allowing unrolling of paper and tearing of sheets therefrom.

* * * * *